US007178317B1

(12) United States Patent
Koskela

(10) Patent No.: US 7,178,317 B1
(45) Date of Patent: Feb. 20, 2007

(54) WRAPPING APPARATUS COMPRISING A DISPENSER FOR DISPENSING STRETCHED WRAP FILM

(75) Inventor: Janne Koskela, Raisio (FI)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/362,929

(22) Filed: Feb. 28, 2006

(51) Int. Cl.
*B65B 11/04* (2006.01)

(52) U.S. Cl. ..... 53/587; 53/211; 242/597.8

(58) Field of Classification Search ..... 53/556, 53/587, 118, 399, 211; 242/419.6, 419.8, 242/419.9, 550, 566, 597.7, 597.8, 615.2
See application file for complete search history.

(56) References Cited

U.S. PATENT DOCUMENTS 2,455,051 A * 11/1948 Fairbanks ..... 226/83
4,914,891 A * 4/1990 Suolahti ..... 53/399
5,014,489 A * 5/1991 Terminella et al. ..... 53/51
5,408,808 A * 4/1995 Masuda et al. ..... 53/556
5,414,979 A 5/1995 Moore et al.
5,572,850 A * 11/1996 Lancaster et al. ..... 53/399
5,794,418 A * 8/1998 Lai ..... 53/556
6,082,081 A * 7/2000 Mucha ..... 53/556
6,195,961 B1 * 3/2001 Turfan ..... 53/389.2
6,625,954 B2 * 9/2003 Forrest ..... 53/399

* cited by examiner

*Primary Examiner*—Rinaldi I. Rada
*Assistant Examiner*—Candace Brakewood
(74) *Attorney, Agent, or Firm*—Schwartz & Weinrieb

(57) ABSTRACT

Wrapping apparatus comprises a dispenser, for dispensing stretched wrap film, which includes a first frame assembly, and a second frame assembly pivotally mounted upon the first frame assembly between a first closed position and second open position. A film roll spindle is mounted upon the second frame assembly along with a plurality of guide rollers, while upstream and downstream prestretch rollers are mounted upon the first frame assembly. When the second frame assembly is disposed at the second open position, the film roll spindle and guide rollers project outwardly in a tilted orientation such that the exchange of film rolls, and the threading of the film between the guide rollers and the prestretch rollers, is facilitated.

22 Claims, 6 Drawing Sheets

WRAPPING APPARATUS COMPRISING A DISPENSER FOR DISPENSING STRETCHED WRAP FILM

FIELD OF THE INVENTION

The present invention relates to a wrapping apparatus comprising a dispenser for dispensing stretched wrap film for wrapping around a load.

BACKGROUND OF THE INVENTION

In prior art, specification U.S. Pat. No. 5,414,979 discloses a wrapping apparatus that includes a dispenser for dispensing stretched wrap film. The dispenser includes a first frame assembly and a second frame assembly. The second frame assembly is hinged to the first frame assembly so as to be able to be turned about a vertical hinge axis in relation to the first frame assembly. Further the dispenser includes a film roll holder for rotatably holding a film roll. The film roll holder is arranged in the first frame assembly in a substantially vertical position. In U.S. Pat. No. 5,414,979 the film roll holder is mounted in the first frame assembly. The dispenser also includes upstream and downstream prestretch rollers for engaging a first side of the film, which upstream and downstream prestretch rollers are mounted in the first frame. Further, the dispenser includes guide rollers for engaging the second side of the film in the near proximity of the upstream and downstream prestretch rollers. The guide rollers deflect and guide the film to follow a tortuous path around the guide rollers and the prestretch rollers. The guide rollers are mounted in the second frame assembly. Therefore, the second frame assembly can be moved between a closed position and an open position. In the closed position the second frame assembly is in a position in which the film roll spindle and the guide rollers are proximate and parallel with respect to the prestretch rollers. In the open position the guide rollers are moved with the second frame assembly about the vertical hinge axis so that a sidewards open gap is formed between the prestretch rollers and the guide rollers.

A problem arises in the situation when it is necessary to exchange or replace the film roll. In the prior art dispenser this is very time consuming and laborious, because the film roll holder always preserves its vertical orientation in the first frame assembly being stationary in the film dispenser. Further, film threading is difficult because the operator must insert his hand and fingers inside the dispenser in order to pull the film from the film roll located behind the prestretch rollers to the front side of the prestretch rollers.

Further, this problem becomes even worse in a wrapping apparatus of turntable type wherein it is desirable to encapsulate the film dispenser inside the inner space of the vertical box-like column wherein the dispenser is guided for vertical movement. Such a desirable column has a doorway through which the film roll exchange and film threading must be made. The inner space is narrow and there is only little space in the inner space to operate with hands and fingers for replacement of the film roll and for film threading.

OBJECTS OF THE INVENTION

The object of the present invention is to overcome the above-mentioned drawbacks.

Accordingly, it is an object of the present invention to provide a new and improved wrapping apparatus having a film dispenser which enables an easy and ergonomic film roll exchange and film threading between the guide and prestretch rollers of the film dispenser.

Another object of the present invention is to provide a new and improved wrapping apparatus, which will overcome the various operational drawbacks and disadvantages characteristic of the conventional wrapping apparatus.

SUMMARY OF THE INVENTION

The foregoing and other objects are achieved in accordance with the teachings of the present invention through the provision of a new and improved wrapping apparatus which comprises a dispenser for dispensing stretched wrap film, the film having a first side and a second side, the dispenser including a first frame assembly having a first base member; a second frame assembly having a second base member mounted to the first base member by a hinge having a substantially horizontal hinge axis, the second frame assembly being able to be tilted around the hinge axis; a film roll spindle for rotatably holding a film roll in the dispenser in a substantially vertical position, the spindle being mounted in the second frame assembly; upstream and downstream prestretch rollers for engaging the first side of the film, the upstream and downstream prestretch rollers being mounted in the first frame assembly; guide rollers for engaging the second side of the film in the near proximity of the upstream and downstream prestretch rollers for deflecting and guiding the film to form a tortuous path around the guide and prestretch rollers, the guide rollers being mounted in the second frame assembly. The second frame assembly is movable between a closed position and an open position. In the closed position the second frame assembly is in a position in which the film roll spindle and the guide rollers are parallel with respect to the prestretch rollers. In the open position the film roll spindle and guide rollers are tilted to an angle with respect to the prestretch rollers in order to enable film threading to an upwardly opening gap formed between the prestretch rollers and the guide rollers and to facilitate exchange of the film rolls.

Further, a new and improved wrapping apparatus is provided, comprising a turntable for rotatably supporting a load to be wrapped; a vertical box-like column having a wall defining a vertically elongated inner space inside the box-like column, and vertical guide means arranged in the inner space, said wall having a doorway with a door; a dispenser for dispensing stretched wrap film, the film having a first side and a second side, the dispenser being arranged in the inner space of the box-like column and guided therein for vertical movement by the vertical guide means. The dispenser includes a first frame assembly having a first base member; a second frame assembly having a second base member mounted to the first base member by a hinge having a substantially horizontal hinge axis, the second frame assembly being able to be tilted around the hinge axis; a film roll spindle of rotatably holding a film roll in the dispenser in a substantially vertical position, the spindle being mounted in the second frame; upstream and downstream prestretch rollers for engaging the first side of the film, the upstream and downstream prestretch rollers being mounted in the first frame; and guide rollers for engaging the second side of the film in the near proximity of the upstream and downstream prestretch rollers for deflecting and guiding the film to form a tortuous path around the guide and prestretch rollers, the guide rollers being mounted in the second frame. The second frame assembly is movable between a closed position and an open position. In the closed position the second frame assembly is in a position in which the film roll spindle and guide rollers are parallel with respect to the prestretch rollers. In the open position the film roll spindle and guide rollers are tilted to an angle with respect to the prestretch rollers in order to enable film threading to an upwardly opening gap formed between the prestretch rollers and the guide rollers and, and in which open position at least the upper end of the film roll extends through the doorway to the outside of the box-like column to facilitate exchange of the film rolls.

The invention has the advantage that the exchange of the film roll is made very easy as the second frame assembly is pivotally moved from its closed position to its open position such that the film roll spindle is moved from its vertical orientation and tilted outwardly so as to be easily accessible for the operator. Simultaneously with this pivotal movement of the second frame assembly, an upwardly open gap is formed between the prestretch rollers and the guide rollers and is readily accessible from above for film threading.

In an embodiment of the wrapping apparatus in the second position the second frame assembly is tilted so that the angle of the film roll spindle axis with respect to vertical direction is less than 90 degrees.

In an embodiment of the wrapping apparatus the dispenser comprises a releasable latch for releasably locking the second frame assembly and the first frame assembly together in the closed position.

In an embodiment of the wrapping apparatus the film roll spindle adapted to be inserted into the center hole of the film roll has a lower end mounted on the second base member the spindle extending from the second base member to a free upper end.

In an embodiment of the wrapping apparatus the second frame assembly comprises an upper member, and the guide rollers have an upper end mounted on the upper member and a lower end mounted on the second base member.

In an embodiment of the wrapping apparatus the dispenser comprises a motor for driving the prestretch rollers.

In an embodiment of the wrapping apparatus the guide rollers are idler rollers.

In an embodiment of the wrapping apparatus the guide rollers include a first guide roller, a second guide roller and a third guide roller which in the closed position of the second frame assembly are arranged so that the first guide roller is located upstream of the upstream prestretch roller, the second guide roller is located between the upstream prestretch roller and the downstream prestretch roller, and the third guide roller is located downstream of the downstream prestretch roller.

In an embodiment of the wrapping apparatus the dispenser includes means for detecting film tension, said means being arranged in the first frame assembly and located downstream of the third guide roller.

In an embodiment of the wrapping apparatus the means for detecting film tension comprises a spring loaded pendulum roller engaging the second side of the film, and a detector for detecting the rotational angle of the pendulum roller.

In an embodiment of the wrapping apparatus the wall of the box-like column comprises a vertical slot through which the film dispensed by the dispenser can be lead from the inner space of the column to the outside of the column to wrap the load.

In an embodiment of the wrapping apparatus in the open position at least the upper ends of the guide rollers extend through the doorway to the outside of the box-like column to expose the upwardly opening gap between the prestretch rollers and the guide rollers for film threading.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
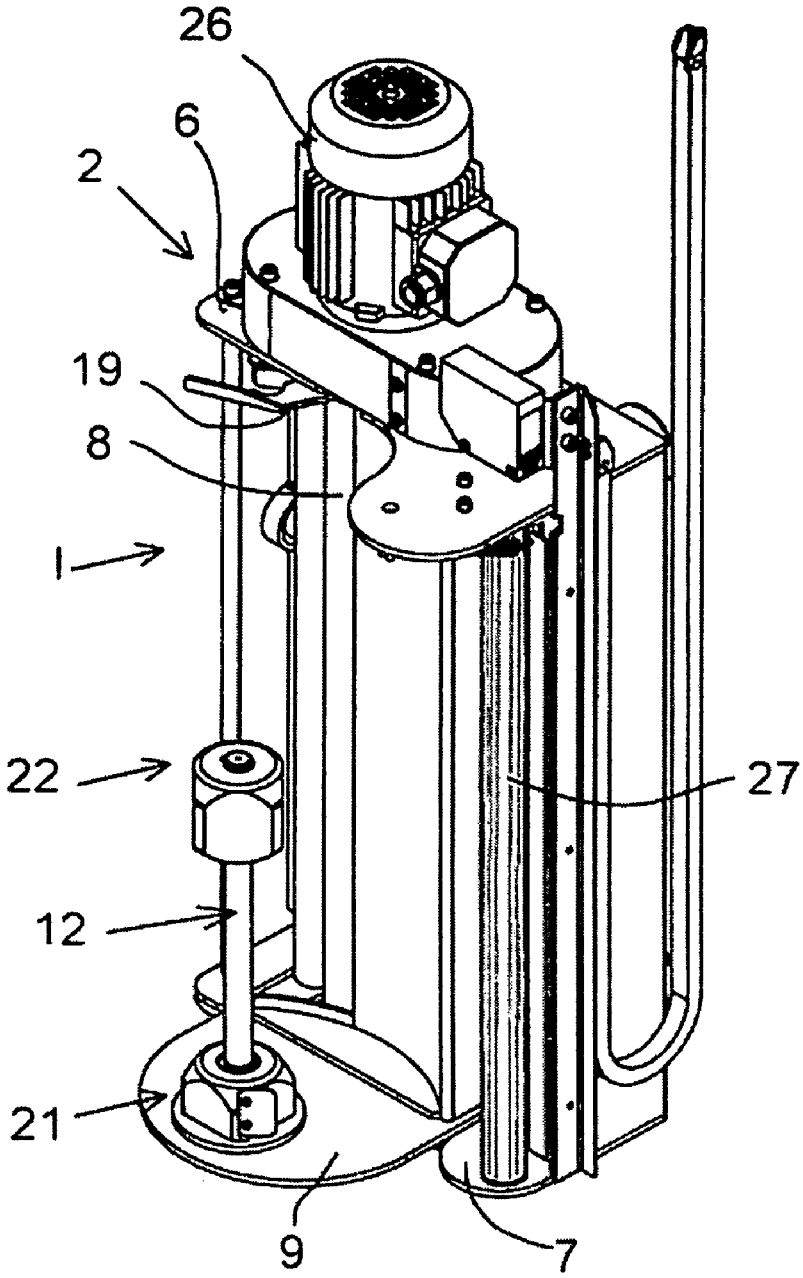
FIG. 1 is a perspective view of the dispenser of the new and improved wrapping apparatus the second frame assembly being shown in a closed position.
Figure 2:
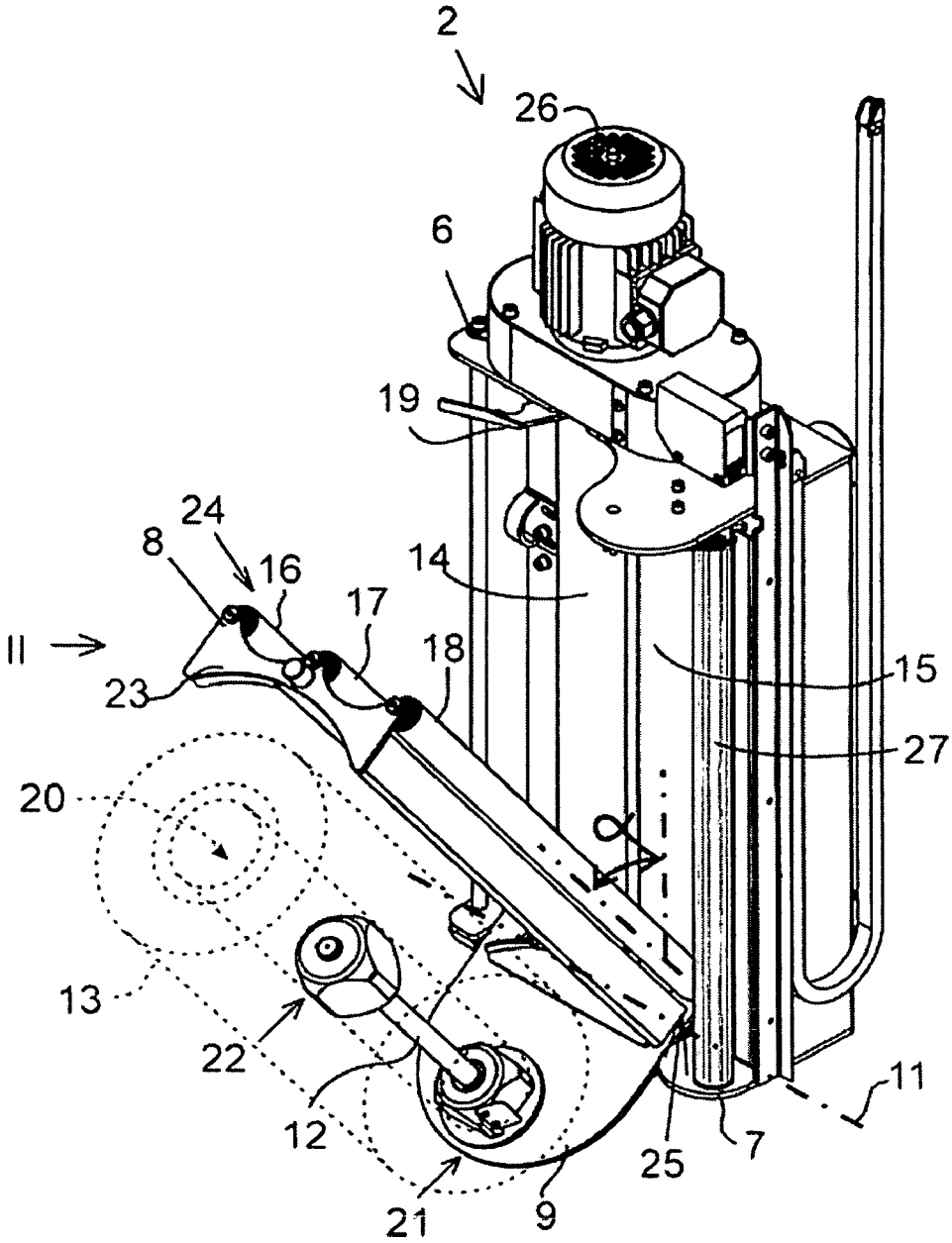
FIG. 2 represents the dispenser of FIG. 1 with the second frame assembly being tilted in an open position with respect to the first frame assembly.
Figure 3:
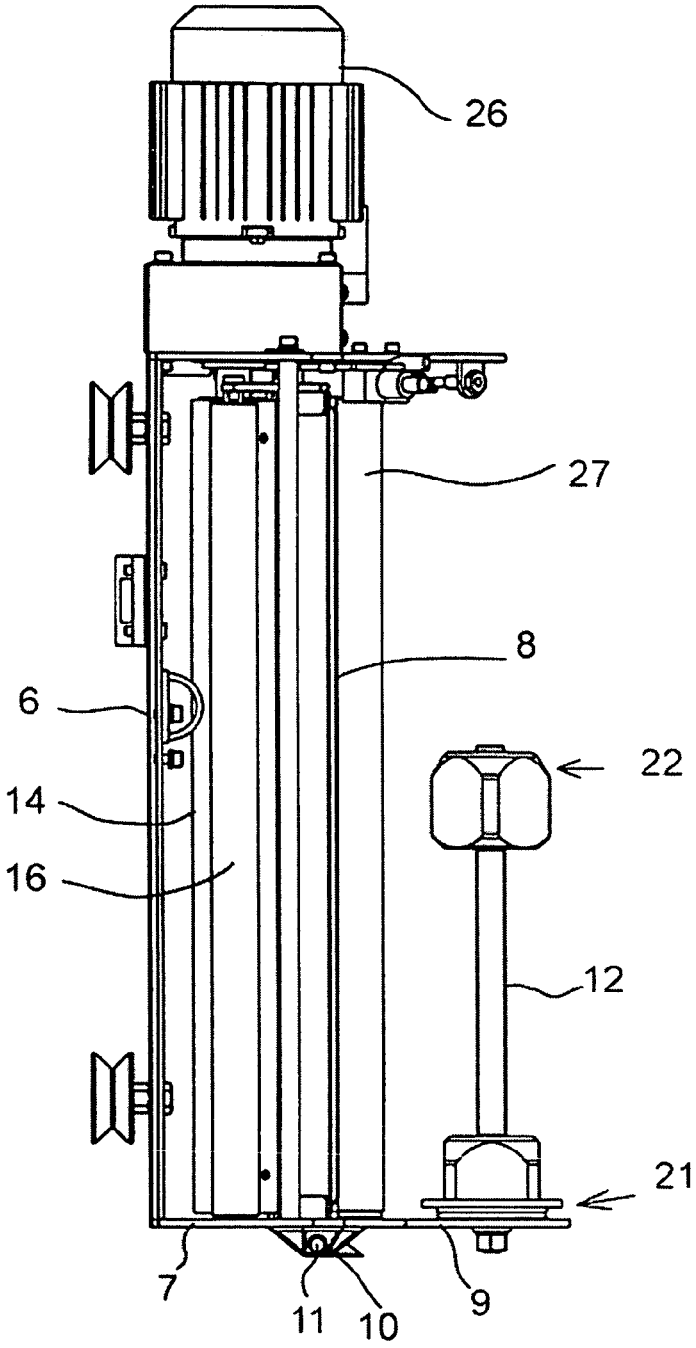
FIG. 3 is a side view of the dispenser of FIG. 1.

FIGS. 1 to 3 show a film dispenser 2 which is provided for dispensing stretched wrap plastic film (not shown) in a wrapping apparatus.

As can be seen from FIGS. 1, 2 and 3 the dispenser 2 includes a first frame assembly 6 having a first base member 7 and a second frame assembly 8 having a second base member 9. The second base member 9 is pivotally mounted to first base member 7 by a hinge 10 (in FIG. 3). The hinge 10 has a substantially horizontal hinge axis 11. The second frame assembly 8 can be tilted around the hinge axis 11 between a closed position I shown in FIG. 1 and an open position II shown in FIG. 2.

Further, the dispenser 2 comprises a film roll spindle 12 which is adapted to hold a film roll 13 in the dispenser 2 in a substantially vertical position when it is ready for operation in the closed position I. In FIG. 2 the film roll 13 is schematically drawn with broken lines. The spindle 12 allows free rotation of the film roll 13. The spindle 12 is mounted on the second base member 9 in the second frame assembly 8. The film roll spindle 12 is adapted to be inserted into the center hole 20 of the film roll 13. The lower end 21 of the spindle 12 is mounted on the second base member 9 of the second frame assembly 8 wherefrom the spindle extends upwards to its free upper end 22.

Further, the dispenser 2 includes an upstream prestretch roller 14 and a downstream prestretch roller 15, which are driven by a motor 26 with a chain and sprocket drive at a preselected velocity ratio.

The prestretch rollers 14 and 15 may have a suitable coating of resilient nonslip material such as rubber to provide a sufficient friction gripping to the film. The prestretch rollers have different peripheral speeds so that the downstream prestretch roller 15 has a faster peripheral speed than the upstream prestretch roller 14 to stretch the film between the prestretch rollers 14 and 15. In some applications it is desirable to stretch film over its yield point to plastically deform the film in the direction in which it is being dispensed.

The prestretch rollers 14 and 15 engage the first side 4 of the film 3. The upstream and downstream prestretch rollers 14 and 15 are mounted in the first frame assembly 6.

Figure 6:
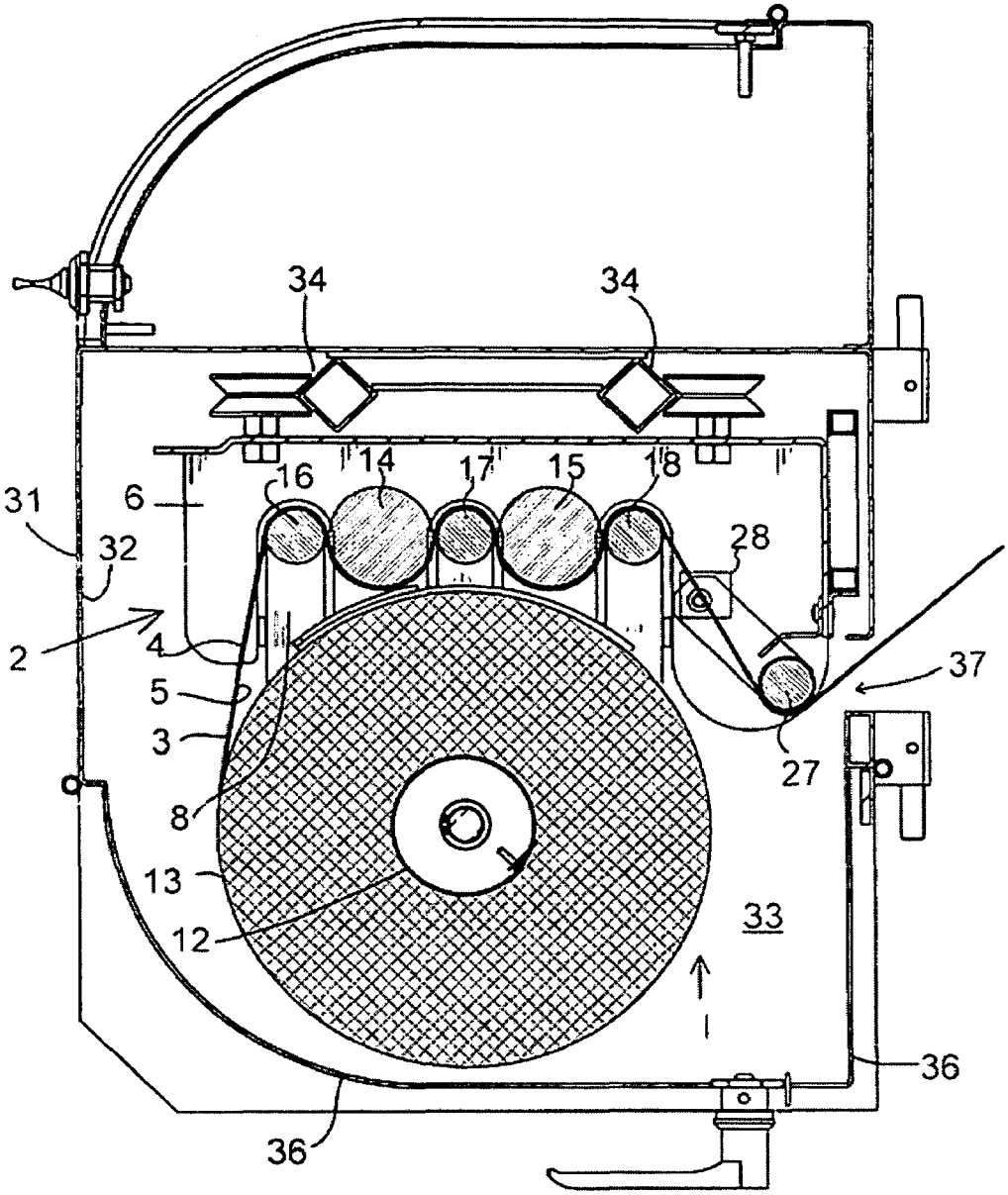
FIG. 6 represents a diagrammatic section VI—VI through FIG. 5.

Further, the dispenser 2 includes guide rollers 16, 17 and 18, which are idlers and engage the second side 5 of the film 3 in the near proximity of the upstream and downstream prestretch rollers 14 and 15 for deflecting and guiding the film 3 so that the film 3 forms a tortuous W-shaped path around the guid rollers 16, 17, 18 and the prestretch rollers 14 and 15 (see also FIG. 6). The guide rollers 16, 17, and 18 are mounted in the second frame assembly 8. In the preferred example of FIGS. 1 to 3 the guide rollers include a first guide roller 16, a second guide roller 17 and a third guide roller 18. In the closed position I of the second frame assembly 8 the guide rollers are arranged so that the first guide roller 16 is located upstream of the upstream prestretch roller 14. The second guide roller 17 is located between the upstream prestretch roller 14 and the downstream prestretch roller 15. The third guide roller 18 is located downstream of the downstream prestretch roller 15. The second frame assembly 8 comprises an upper member 23. The guide rollers 16, 17, 18 have their upper ends 24 mounted on the upper member 23 and lower ends 25 mounted on the second base member 9.

As can be seen in FIGS. 1 and 2 the second frame assembly can be moved between a closed position I and an open position II. In the closed position I of FIG. 1 and which also can be seen in FIG. 6, the second frame assembly 8 is in a position in which the film roll spindle 12 and the guide rollers 16, 17 and 18 are parallel with respect to the prestretch rollers 14 and 15. In the open position II of FIG. 2 the second frame assembly 8 with its film roll spindle 12 and guide rollers 16, 17 and 18 are tilted to a suitable angle $\alpha$ with respect to the first frame assembly 8 and the prestretch rollers 14 and 15. The purpose of this tilting operation is to enable the operator an easy access to the spindle 12 to facilitate exchange of the film rolls in the spindle 12 and also to enable an ergonomic and easy film threading to an upwardly opening gap which is formed between the prestretch rollers 14, 15 and the guide rollers 16, 17, 18. The angle $\alpha$ of the film roll spindle axis with respect to vertical direction in the example of the FIG. 2 is about 30 to 50 degrees but can be adjusted according to specific needs to any suitable angle less than 90 degrees.

Further, the dispenser 2 comprises a releasable latch 19 for releasably locking the second frame assembly 8 and the first frame assembly 6 together in the closed position I.

As can be seen in FIGS. 1, 2 and 6, the dispenser 2 further includes means for detecting film tension being arranged in the first frame assembly 6 and located downstream of the third guide roller. The means for detecting film tension comprises a spring loaded pendulum roller 27 which engages the first side 4 of the film 3. A detector 28 is arranged for detecting the rotational angle of the pendulum roller 27. The speed of the motor 26 is adjusted in relation to the angle detected by the detector 28.

Figure 4:
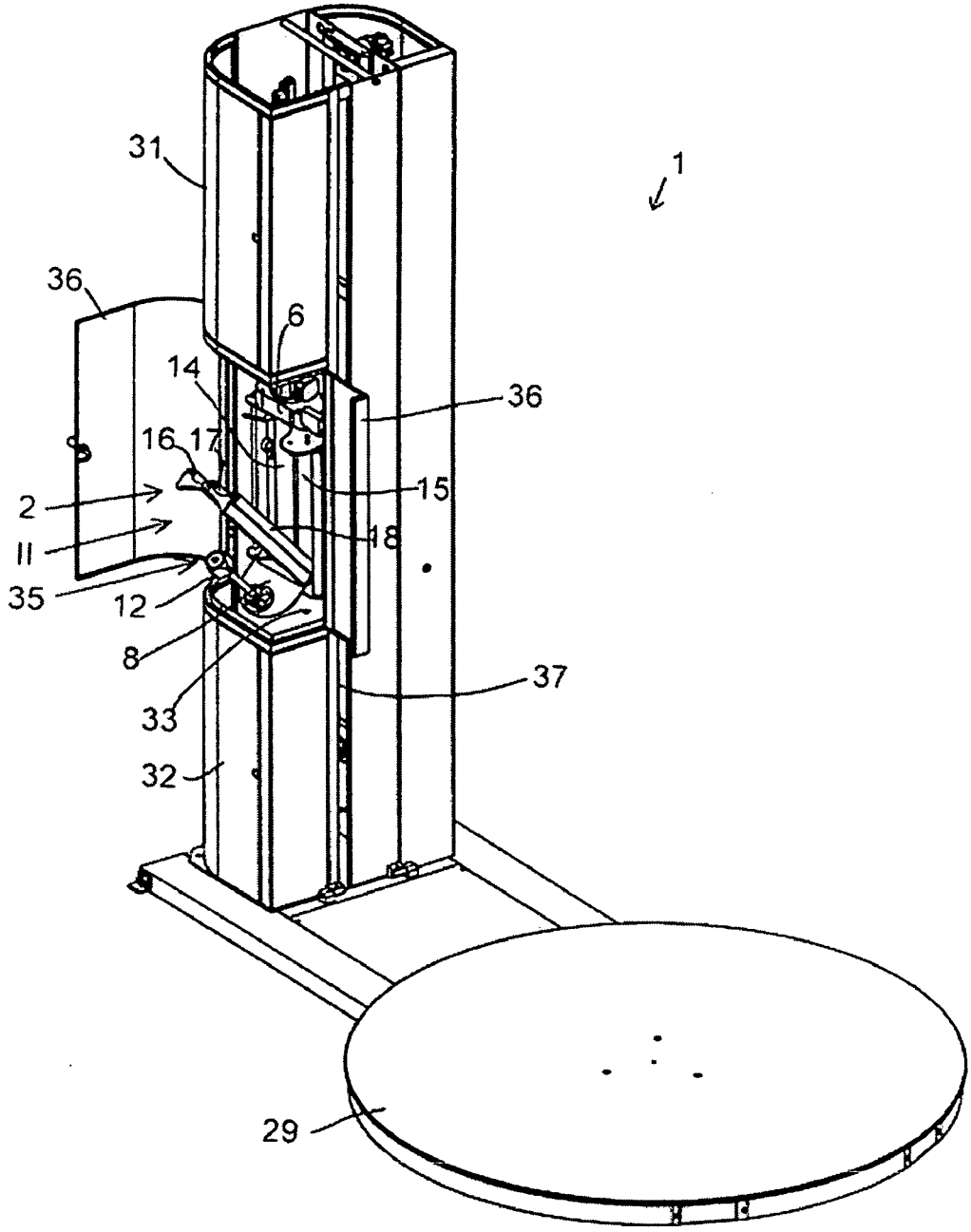
FIG. 4 is a perspective view of the new and improved wrapping apparatus seen from one angle.
Figure 5:
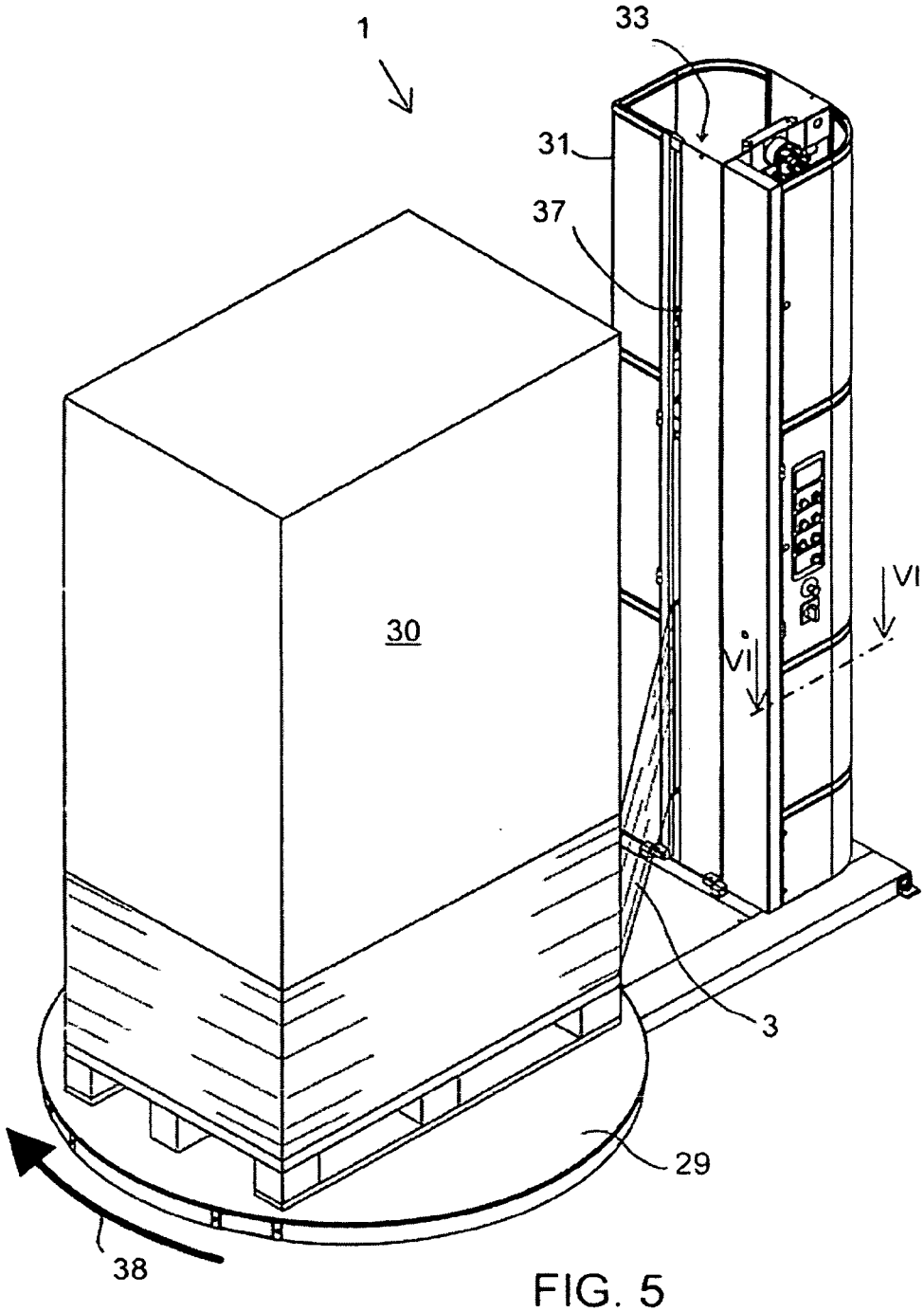
FIG. 5 is a perspective view of the wrapping apparatus of FIG. 4 seen from another angle during wrapping of a load.

FIGS. 4, 5 and 6 show a wrapping apparatus 1 provided with the dispenser 2 disclosed above with reference to FIGS. 1 to 3.

The wrapping apparatus 1 includes a turntable 29 for rotatably supporting a load 30 to be wrapped as is schematically shown in FIG. 5. Further, the wrapping apparatus 1 includes a vertical box-like column 31 having a wall structure 32 which defines a vertically elongated inner space 33 inside the box-like column 31. A vertical guide 34 means is arranged in the inner space 33 and attached to the back wall of the inner space 33. The dispenser 2 is arranged in the inner space of the box-like column 31 and guided therein for vertical movement by the vertical guide means 34 as is shown in the section view, see FIG. 6.

The wall 31 has a doorway 35 provided with doors 36. In FIG. 4 the doors 36 are opened and the second frame assembly 8 is tilted to an angle in relation to the first frame assembly 6.

The second frame assembly 8 is movable between a closed position I and an open position II as shown in FIG. 4. In the closed position I the second frame assembly 8 is in a position as shown in FIG. 1.

In the open position II as shown in FIG. 2 and 4 the film roll spindle 12 and guide rollers 1 are tilted to an angle with respect to the prestretch rollers so that the film roll spindle 12 and at least the upper parts of the guide rollers 16, 17, 18 extend obliquely through the doorway 35 to the outside of the box-like column 31 to expose the upwardly opening gap between the prestretch rollers and the guide rollers for film threading and to provide ergonomic and easy access to the spindle 12 for exchanging the film rolls.

As can be seen in FIGS. 4 to 6, the wall of the box-like column 31 comprises a vertical slot 37 through which the film 3 dispensed by the dispenser 2 is led from the inner space 33 of the column 31 to the outside of the column 31 to wrap the load 30 as the load 30 is rotated by the turntable 29 to the rotational direction shown with arrow 38.

Obviously, many modifications and variations of the present invention are possible in light of the above teachings. It is therefore to be understood that within the scope of the appended claims, the present invention may be practiced otherwise than as specifically described herein.

The invention claimed is:

1. Wrapping apparatus for dispensing stretched wrap film, having a first side and a second side, toward an article to be wrapped, comprising:

a first frame assembly;

a second frame assembly;

a film roll spindle, for rotatably holding a roll of film, mounted upon said second frame assembly;

upstream and downstream prestretch rollers rotatably mounted upon said first frame assembly for engaging the first side of the film; and a plurality of guide rollers rotatably mounted upon said second frame assembly for engaging the second side of the film;

said second frame assembly being pivotally mounted upon said first frame assembly about a pivotal axis so as to enable said second frame assembly to be tilted around said pivotal axis with respect to said first frame assembly between a first closed position at which said plurality of guide rollers operatively cooperate with said upstream and downstream prestretch rollers so as to define with said upstream and downstream prestretch rollers a substantially tortuous path along which the film is guidingly conducted and stretched, and a second open position at which said film roll spindle and said plurality of guide rollers are disposed at a predetermined angle with respect to said upstream and downstream prestretch rollers in order to define a gap between said plurality of guide rollers and said upstream and downstream prestretch rollers so as to facilitate the threading of the film between said plurality of guide rollers and said upstream and downstream prestretch rollers.

2. The wrapping apparatus as set forth in claim 1, wherein:

said pivotal axis, around which said second frame assembly is pivotally movable with respect to said first frame assembly, is oriented horizontally; and when said second frame assembly is disposed at said second open position with respect to said first frame assembly, said film roll spindle, defined around a film roll spindle axis, will be oriented at a predetermined angle, with respect to vertical, which is less than 90 degrees.

3. The wrapping apparatus as set forth in claim 1, further comprising:

latch means for releasably locking said second frame assembly at said first closed position with respect to said first frame assembly.

4. The wrapping apparatus as set forth in claim 1, wherein:

said second frame assembly comprises a base member; and said film roll spindle, adapted to be inserted into a central hole of the film roll, has a lower end portion thereof mounted upon said base member of said second frame assembly such that said film roll spindle extends upwardly from said base member of said second frame assembly toward a free upper end portion thereof.

5. The wrapping apparatus as set forth in claim 4, wherein:

said second frame assembly further comprises an upper member; and said plurality of guide rollers have upper end portions thereof mounted upon said upper member of said second frame assembly and lower end portions thereof mounted upon said base member of said second frame assembly.

6. The wrapping apparatus as set forth in claim 1, further comprising:

motor means for driving said upstream and downstream prestretch rollers.

7. The wrapping apparatus as set forth in claim 1, wherein:

said plurality of guide rollers are idler rollers.

8. The wrapping apparatus as set forth in claim 1, wherein:

said plurality of guide rollers comprises first, second, and third guide rollers wherein, when said second frame assembly is disposed at said first closed position with respect to said first frame assembly, said first guide roller is located upstream of said upstream prestretch roller, said second guide roller is interposed between said upstream prestretch roller and said downstream prestretch roller, and said third guide roller is located downstream of said downstream prestretch roller as considered in the direction that the film is dispensed from said film roll spindle toward the article to be wrapped.

9. The wrapping apparatus as set forth in claim 1, further comprising:

means, for detecting film tension, mounted upon said first frame assembly and located downstream of said third guide roller.

10. The wrapping apparatus as set forth in claim 9, wherein said means for detecting film tension comprises:

a spring loaded pendulum roller engaging the second side of the film; and a detector for detecting the rotational angle of said pendulum roller.

11. Wrapping apparatus for dispensing stretched wrap film, having a first side and a second side, toward a load to be wrapped, comprising:

a turntable for rotatably supporting a load to be wrapped;

a vertically oriented box-like column disposed adjacent to said turntable and having wall structure defining a vertically elongated inner space inside said vertically-oriented box-like column;

a doorway defined within said wall structure;

a dispenser, for dispensing stretched wrap film having a first side and a second side, disposed within said inner space defined within said vertically oriented box-like column;

said dispenser comprising a first frame assembly; a second frame assembly; a film roll spindle, for rotatably holding a roll of film, mounted upon said second frame assembly; upstream and downstream prestretch rollers rotatably mounted upon said first frame assembly for engaging the first side of the film; a plurality of guide rollers rotatably mounted upon said said second frame assembly for engaging the second side of the film; said second frame assembly being pivotally mounted upon said first frame assembly about a pivotal axis so as to enable said second frame assembly to be tilted around said pivotal axis with respect to said first frame assembly between a first closed position at which said plurality of guide rollers operatively cooperate with said upstream and downstream prestretch rollers so as to define with said upstream and downstream prestretch rollers a substantially tortuous path along which the film is guidingly conducted and stretched, and a second open position at which said film roll spindle and said plurality of guide rollers extend outwardly through said doorway and are disposed at a predetermined angle with respect to said upstream and downstream prestretch rollers in order to define a gap between said plurality of guide rollers and said upstream and downstream prestretch rollers so as to facilitate the threading of the film between said plurality of guide rollers and said upstream and downstream prestretch rollers.

12. The wrapping apparatus as set forth in claim 11, wherein:

said pivotal axis, around which said second frame assembly is pivotally movable with respect to said first frame assembly, is oriented horizontally, and when said second frame assembly is disposed at said second open position with respect to said first frame assembly, said film roll spindle, defined around a film roll spindle axis, will be oriented at a predetermined angle, with respect to vertical, which is less than 90 degrees.

13. The wrapping apparatus as set forth in claim 11, further comprising:

latch means for releasably locking said second frame assembly at said first closed position with respect to said first frame assembly.

14. The wrapping apparatus as set forth in claim 11, wherein:

said second frame assembly comprises a base member; and said film roll spindle, adapted to be inserted into a central hole of the film roll, has a lower end portion thereof mounted upon said base member of said second frame assembly such that said film roll spindle extends upwardly from said base member of said second frame assembly toward a free upper end portion thereof.

15. The wrapping apparatus as set forth in claim 14, wherein:

said second frame assembly further comprises an upper member; and said plurality of guide rollers have upper end portions thereof mounted upon said upper member of said second frame assembly and lower end portions thereof mounted upon said base member of said second frame assembly.

16. The wrapping apparatus as set forth in claim 11, further comprising:

motor means for driving said upstream and downstream prestretch rollers.

17. The wrapping apparatus as set forth in claim 11, wherein:

said plurality of guide rollers are idler rollers.

18. The wrapping apparatus as set forth in claim 11, wherein:

said plurality of guide rollers comprises first, second, and third guide rollers wherein, when said second frame assembly is disposed at said first closed position with respect to said first frame assembly, said first guide roller is located upstream of said upstream prestretch roller, said second guide roller is interposed between said upstream prestretch roller and said downstream prestretch roller, and said third guide roller is located downstream of said downstream prestretch roller as considered in the direction that the film is dispensed from said film roll spindle toward the load to be wrapped.

19. The wrapping apparatus as set forth in claim 11, wherein:

said wall structure of said vertically oriented box-like column comprises a vertical slot through which the film dispensed by said dispenser can be led out from said inner space defined within said vertically oriented box-like column toward the outside of said vertically oriented box-like column so as to wrap the load.

20. The wrapping apparatus as set forth in claim 11, further comprising:

means, for detecting film tension, mounted upon said first frame assembly and located downstream of said third guide roller.

21. The wrapping apparatus as set forth in claim 20, wherein said means for detecting film tension comprises:

a spring loaded pendulum roller engaging the second side of the film; and a detector for detecting the rotational angle of said pendulum roller.

22. The wrapping apparatus as set forth in claim 11, further comprising:

vertical guide means disposed within said inner space of said vertically oriented box-like column for guiding vertical movements of said dispenser.

* * * * *